US005868648A

United States Patent [19]

Coody et al.

[11] Patent Number: 5,868,648

[45] Date of Patent: Feb. 9, 1999

[54] FOLDABLE TREADMILL APPARATUS AND METHOD

[75] Inventors: Bruce Coody, Auburn; Greg Harris, Opelika, both of Ala.

[73] Assignee: FF Acquisition Corp., West Point, Miss.

[21] Appl. No.: 647,620

[22] Filed: May 13, 1996

[51] Int. Cl.[6] ..... A63B 22/02

[52] U.S. Cl. ..... 482/54; 482/51

[58] Field of Search ..... 482/51, 54, 61, 482/71, 111, 112

[56] References Cited

U.S. PATENT DOCUMENTS

| | | |
|---|---|---|
| D. 207,541 | 5/1967 | Hesen . |
| D. 211,801 | 7/1968 | Quinton . |
| D. 217,173 | 4/1970 | Frasier . |
| D. 270,555 | 9/1983 | Ogden . |
| D. 277,304 | 1/1985 | Smith et al. . |
| D. 283,239 | 4/1986 | Smith et al. . |
| 284,294 | 9/1883 | Graves . |
| D. 284,597 | 7/1986 | Smith et al. . |
| D. 304,849 | 11/1989 | Watterson . |
| D. 306,468 | 3/1990 | Watterson . |
| D. 306,891 | 3/1990 | Watterson . |
| D. 316,124 | 4/1991 | Dalebout et al. . |
| 321,388 | 6/1885 | Ruebsam . |
| D. 323,009 | 1/1992 | Dalebout et al. . |
| D. 323,198 | 1/1992 | Dalebout et al. . |

(List continued on next page.)

FOREIGN PATENT DOCUMENTS

| | | |
|---|---|---|
| 0 095 226 | 3/1983 | European Pat. Off. . |
| 1468272 | 2/1966 | France . |
| 71.31842 | 4/1973 | France . |
| 83466 | 8/1908 | Germany . |
| 2 215 119 | 11/1973 | Germany . |
| 2 225 342 | 12/1973 | Germany . |
| 24 08 052 | 8/1975 | Germany . |
| 51-10842 | 3/1976 | Japan . |
| 56-56358 | 5/1981 | Japan . |
| 56-150562 | of 1989 | Japan . |
| 825122 | 7/1977 | Russian Federation . |
| 1248615 A1 | 7/1986 | U.S.S.R. . |
| 1169148 | 10/1969 | United Kingdom . |
| 1326263 | 8/1973 | United Kingdom . |
| 1505702 | 3/1978 | United Kingdom . |
| 2 120 560 | 12/1983 | United Kingdom . |
| WO 80/00099 | 6/1981 | WIPO . |

OTHER PUBLICATIONS

Genesis Catalog, 1985.

Advertisment for Sportmart Health & Fitness for the "The Step" (Sportmart Health & Fitness, Jan. 23, 1993, 1 pg.).

Advertisement for "The Step" and The Step II (Sears The Great American Wish Book 1991, 2 pp.).

Advertising for "Introducing The New Step Rebook™ Platform" Designed to Meet the Demands of the Health Club Industry, (©1993 Reebook International Ltd., 1 pg.).

Advertisement for "Step II" (Winter 1995 Home Fitness Buyers Guide, p. 69).

Diagram of "HealthRider®" Parts Description (Apr. 26, 1994, 1 pg.).

Voit Advertisement "Body Jack" (Damark, Nov. 1–4, 1994, 1 pg.).

(List continued on next page.)

*Primary Examiner*—Lynne A. Reichard

*Attorney, Agent, or Firm*—Brinks Hofer Gilson & Lione

[57] ABSTRACT

A treadmill includes an up-right support, a track bed, and a gas spring attached at one end to the up-right support, and at the other end to the track bed. The treadmill further includes a latch attached to the up-right support adapted to connect with the end of the gas spring which is attached to the track bed. The latch may, preferably attach to a rod, which extends from the track bed and is attached to the gas spring. An incline motor attached to a middle portion of a frame retracts or extends a motor tube. This action, rotates an incline bracket connected to the motor tube and to a rear portion of a frame, to lower or raise a set of wheels connected to at the ends of the incline bracket.

23 Claims, 4 Drawing Sheets

U.S. PATENT DOCUMENTS

D. 323,199 1/1992 Dalebout et al. .
D. 344,112 2/1994 Smith .
D. 344,557 2/1994 Ashby .
D. 348,493 7/1994 Ashby .
D. 348,494 7/1994 Ashby .
D. 351,202 10/1994 Bingham .
D. 351,633 10/1994 Bingham .
D. 356,128 3/1995 Smith et al. .
D. 358,437 5/1995 Wang et al. .
D. 361,806 8/1995 Bartlett .
D. 361,807 8/1995 Bartlett .
659,216 10/1900 Durham .
663,486 12/1900 Boren .
881,521 3/1908 Wilson .
931,394 8/1909 Day .
1,020,777 3/1912 Peterson .
1,064,968 6/1913 Hagen .
1,082,940 12/1913 Flora .
1,715,870 6/1929 Spain .
1,778,635 10/1930 Heisler .
1,824,406 9/1931 Petersime .
1,850,530 3/1932 Brown .
1,902,694 3/1933 Edwards .
1,928,089 9/1933 Blickman .
1,973,945 9/1934 Chavin et al. .
2,145,940 2/1939 Marlowe .
2,440,644 4/1948 Powell .
2,470,544 5/1949 Bell .
2,642,288 6/1953 Bell .
2,714,507 8/1955 Goodrich .
2,855,200 10/1958 Blickman .
2,874,971 2/1959 Devery .
2,924,456 2/1960 Miller .
3,127,171 3/1964 Noland et al. .
3,378,259 4/1968 Kupchinski .
3,446,503 5/1969 Lawton .
3,586,322 6/1971 Kverneland .
3,589,715 6/1971 Mark .
3,606,320 9/1971 Erwin, Jr. .
3,614,097 10/1971 Blickman .
3,642,279 2/1972 Cutter .
3,650,529 3/1972 Salm et al. .
3,659,845 5/1972 Quinton .
3,731,917 5/1973 Townsend .
3,738,649 6/1973 Miller .
3,741,538 6/1973 Lewis et al. .
3,751,033 8/1973 Rosenthal .
3,826,491 7/1974 Elder .
3,858,938 1/1975 Kristensson et al. .
3,874,657 4/1975 Niebojewski .
3,892,404 7/1975 Martucci .
3,918,710 11/1975 Niebojewski .
3,963,101 6/1976 Stadelmann et al. .
3,966,182 6/1976 Stadelmann et al. .
3,976,058 8/1976 Tidwell .
4,026,545 5/1977 Schönenberger .
4,043,552 8/1977 Kerkonian .
4,066,257 1/1978 Moller .
4,093,196 6/1978 Bauer .
4,170,351 10/1979 Ozbey et al. .
4,176,836 12/1979 Coyle .
4,188,030 2/1980 Hooper .
4,248,476 2/1981 Phelps .
4,300,760 11/1981 Bobroff .
4,300,761 11/1981 Howard .
4,344,616 8/1982 Ogden .
4,374,587 2/1983 Ogden .
4,383,714 5/1983 Ishida .
4,406,451 9/1983 Gaetano .
4,422,635 12/1983 Herod et al. .
4,445,683 5/1984 Ogden .
4,452,448 6/1984 Ausherman .
4,502,679 3/1985 De Lorenzo .
4,544,153 10/1985 Babcock ..... 482/71
4,572,500 2/1986 Weiss ..... 482/112
4,576,352 3/1986 Ogden .
4,591,147 5/1986 Smith et al. .
4,625,962 12/1986 Street .
4,635,927 1/1987 Shu .
4,635,928 1/1987 Ogden et al. .
4,641,833 2/1987 Trethewey .
4,643,418 2/1987 Bart .
4,664,371 5/1987 Viander .
4,664,646 5/1987 Rorabaugh .
4,679,787 7/1987 Guilbault .
4,682,750 7/1987 Rudolph et al. .
4,684,126 8/1987 Dalebout et al. .
4,709,918 12/1987 Grinblat .
4,729,558 3/1988 Kuo .
4,751,755 6/1988 Carey, Jr. et al. .
4,757,987 7/1988 Allemand .
4,759,540 7/1988 Yu et al. .
4,776,582 10/1988 Ramhorst .
4,792,134 12/1988 Chen .
4,805,901 2/1989 Kulick .
4,809,976 3/1989 Berger .
4,813,743 3/1989 Mizelle .
4,817,939 4/1989 Augspurger et al. ..... 482/61
4,826,153 5/1989 Schalip .
4,844,449 7/1989 Truslaske .
4,886,266 12/1989 Trulaske .
4,905,330 3/1990 Jacobs .
4,913,396 4/1990 Dalebout et al. .
4,913,423 4/1990 Farran et al. .
4,921,247 5/1990 Sterling .
4,938,473 7/1990 Lee et al. .
4,974,831 12/1990 Dunham .
4,984,810 1/1991 Stearns et al. .
4,998,725 3/1991 Watterson et al. .
5,002,271 3/1991 Gonzales .
5,007,630 4/1991 Real et al. .
5,029,801 7/1991 Dalebout et al. .
5,058,881 10/1991 Measom .
5,072,928 12/1991 Stearns et al. .
5,085,426 2/1992 Wanzer et al. .
5,102,380 4/1992 Jacobson et al. .
5,109,778 5/1992 Berkowitz et al. .
5,110,117 5/1992 Fisher et al. .
5,156,650 10/1992 Bals .
5,163,885 11/1992 Wanzer et al. .
5,178,599 1/1993 Scott .
5,184,988 2/1993 Dunham .
5,192,255 3/1993 Dalebout et al. .
5,207,622 5/1993 Wilkinson et al. .
5,207,628 5/1993 Graham et al. .
5,254,067 10/1993 Habing et al. .
5,282,776 2/1994 Dalebout .
5,299,992 4/1994 Wilkinson .
5,299,997 4/1994 Chen .
5,306,218 4/1994 Chen .
5,330,404 7/1994 Lopeteguy et al. .
5,336,146 8/1994 Piaget et al. ..... 482/54
5,338,277 8/1994 Yang .
5,342,269 8/1994 Huang et al. .
5,344,372 9/1994 Hung .
5,352,167 10/1994 Ulicny .
5,352,169 10/1994 Eschenbach .
5,356,357 10/1994 Wang et al. .
5,366,428 11/1994 Liao .
5,370,594 12/1994 Grinblat .
5,372,559 12/1994 Dalebout et al. .
5,378,212 1/1995 Pin-Kuo .

| | | | |
|---|---|---|---|
| 5,407,408 | 4/1995 | Wilkinson . | |
| 5,421,795 | 6/1995 | Chen . | |
| 5,423,731 | 6/1995 | Chen . | |
| 5,429,568 | 7/1995 | Chen . | |
| 5,441,467 | 8/1995 | Stevens . | |
| 5,447,479 | 9/1995 | Gvoich . | |
| 5,453,066 | 9/1995 | Richter, Jr. . | |
| 5,464,378 | 11/1995 | Yu . | |
| 5,476,431 | 12/1995 | Wilkinson et al. . | |
| 5,518,471 | 5/1996 | Hettinger et al. | 482/54 |
| 5,607,375 | 3/1997 | Dalebout et al. . | |
| 5,662,557 | 9/1997 | Watterson et al. . | |
| 5,669,857 | 9/1997 | Watterson et al. . | |
| 5,672,140 | 9/1997 | Watterson et al. . | |
| 5,674,156 | 10/1997 | Watterson et al. | 482/54 |
| 5,674,453 | 10/1997 | Watterson et al. . | |
| 5,676,624 | 10/1997 | Watterson et al. . | |
| 5,683,332 | 11/1997 | Watterson et al. . | |
| 5,702,325 | 12/1997 | Watterson et al. . | |
| 5,704,879 | 1/1998 | Watterson et al. . | |
| 5,718,657 | 2/1998 | Dalebout et al. . | |
| B1 4,913,396 | 6/1995 | Dalebout et al. . | |

OTHER PUBLICATIONS

Voit Advertisement "Gravity Rider" with enlarged photocopy (Damark, Jul. 28–Aug. 1, 1994, 2 pp.).

Voit Advertisement "Gravity Ridger" (Damark, Jul. 28, 1994, 2 pp.).

Owner's Manual for "Pro–Form® Cross Walk® advantage" (©1994 ICON Health & Fitness, Inc., 18 pp.).

Copy of brochure entitled "Technology For Total Fitness Genesis 1000™" (Genesis, Inc., 1985, 6 pp.).

Copy of brochure entitled "Technology For Total Fitness Genesis 2000™" (Genesis, Inc., 1985), (pp. P004577–P004582, 6 pp.).

Copy of brochure entitled "Technology For Total Fitness Genesis 3000™" (Genesis, Inc., 1985), (pp. P004593–P004594 & P004589–P004592, 6 pp.).

Copy of brochure entitled "Technology For Total Fitness Genesis 4000™", (Genesis, Inc., 1985), (pp. P004583–P004588, 6 pp.).

Copy of brochure for Genesis 1000™, Technology for Total Fitness entitled "The Optimum Performance Home Fitness Center" (©Genesis, Inc. Sep. 1985, 1 pg.).

Copy of brochure for Genesis 2000™, Technology for Total Fitness entitled "The Ultimated in Home Exercise Equipment" (©Genesis, Inc. Sep. 1985, 2 pp.).

Copy of brochure for Genesis 3000™, Technology for Total Fitness entitled "The Dynamic Answer to Home Fitness and Health" (©Genesis, Inc. Sep. 1985, 1 pg.).

Copy of brochure for Genesis 4000™, Technology for Total Fitness entitled "The Modern Approach to Home Fitness and Health" (©Genesis, Inc. Sep. 1985, 2 pp.).

Copy of brochure for Genesis 5000™, Technology for Total Fitness entitled "The Advancement In Home Fitness and Convenience" (©Genesis, Inc. /85, 1 pg.).

Copy of brochure for Genesis 6000™, Technology for Total Fitness entitled "Maximum Workout in Minimal Space" (©Genesis, Inc. /85, 1 pg.).

Copy of brochure for Vitamaster.® 1988 Product Line entitled "*Vitamaster®*" (Vitamaster Industries, Inc., 1988, 10 pp.).

Copy of brochure for Roamaster Fitness Equipment 1989 (Roadmaster Corporation 1989, 6 pp.).

WESLO color photos 1995/1996 Treadmill (4 sheets of colored photos).

Gensis, Inc., *Technology for Total Fitness* Genesis 4000™, 6 pages, 1985.

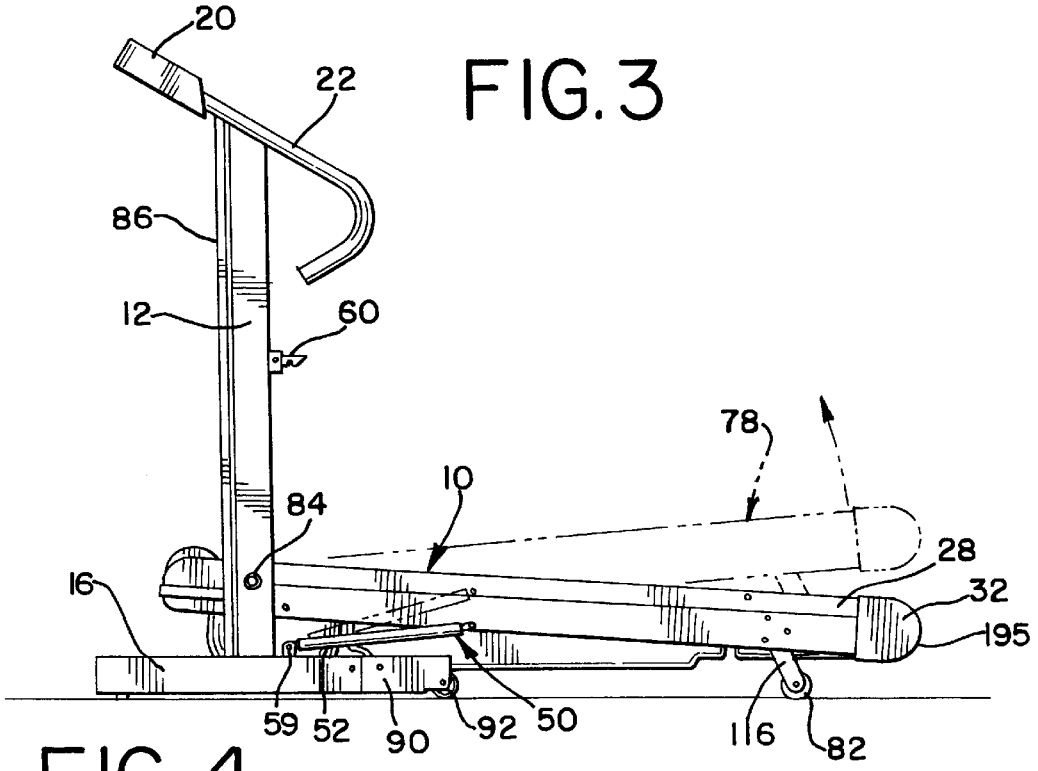
FIG. 3
FIG. 4
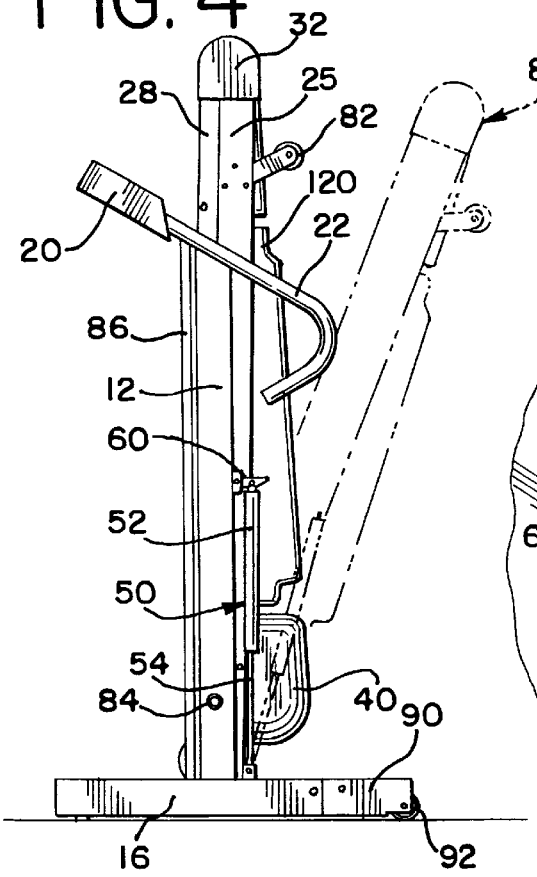
FIG. 5
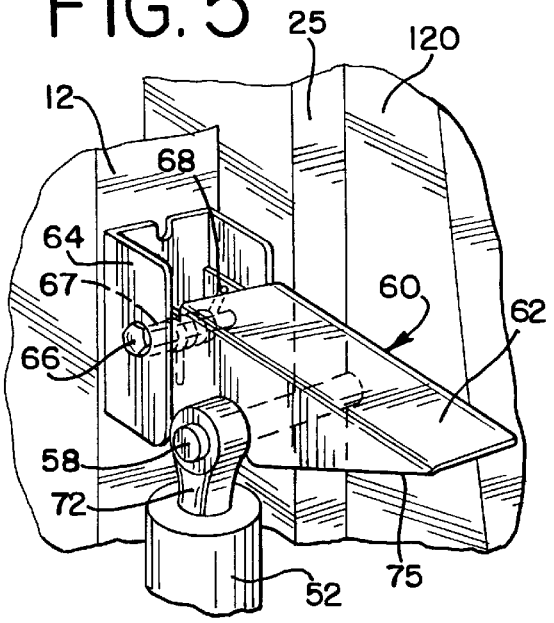

FOLDABLE TREADMILL APPARATUS AND METHOD

TECHNICAL FIELD

The invention relates to an improved treadmill apparatus and method of operating the same. In particular, this invention relates to a treadmill design which allows the track bed to be folded to an up-right position when not in use.

BACKGROUND OF THE INVENTION

Treadmills are a well-known class of exercising machines which are typically difficult to store because of their awkward shape and size. In general, treadmills include a track bed, and a support structure with handle bars. Most treadmills also include a console. Various designs for folding and collapsing treadmills have been or are in present use. Many of these designs are for non-powered treadmills. For example, U.S. Pat. No. 931,394 was an early design of a non-powered foldable treadmill, which discloses a track bed hinged at its forward end to support legs. The simplicity of this design is not easily translatable to a heavier modern treadmill.

One problem with folding a modern treadmill is that the track bed is generally heavier because of various features, including a motor, drive and retractable wheel mechanism. This added weight turns a raised track bed into a hazard. If released from the up-right position, the track bed will rapidly fall and could injure a person. The heavy track bed is also difficult to manually lift to the up-right position and may cause back strain or other injury. It would be desirable to have a track bed that would have an assist device that would prevent the up-right track bed from rapidly falling. Also, it would be desirable for the assist device to reduce the effective weight of the track bed, thus allowing a person to easily lift the track bed to the folded position with minimal effort.

Another problem associated with foldable treadmills is the latch or lock system used to hold the track bed in the up-right position. Once unlatched, the treadmill becomes dangerous if released by the user. It would be desirable to have a lock system that would automatically lock when the track bed is at or near the up-right position.

SUMMARY OF THE INVENTION

The invention provides a treadmill and method of operating the same. The treadmill includes an up-right support, a track bed, and a gas spring attached at one end to the up-right support, and at the other end to the track bed. The treadmill further includes a latch attached to the up-right support adapted to releasably connect to a locking member which is attached to the track bed. The latch may, preferably attach to a rod extending from the track bed and attached to the gas spring.

Preferably, the support includes two up-right support legs and, may further include two support bases attached to the support legs. Extenders may preferably be attached to the support bases to counter the force of the gas spring. The gas spring may preferably be attached at one end to one of the support legs and at the other end to a side portion of the track bed. The gas spring, preferably includes a plunger movably engaged with a gas filled cylinder. Preferably, the outer end of the plunger is attached to the support, and the cylinder is attached to the track bed.

The treadmill further provides for other features including an electric motor which is attached to the track bed.

Preferably, the motor is housed on an underside of the track bed, and positioned in a forward portion of the track bed.

The treadmill further provides for retractable wheels positioned on an underside rear portion of the treadmill. Preferably, the retractable wheels are connected to an electric motor.

The invention further provides for a treadmill including an up-right support, a frame attached at a forward end to the support, an electric motor attached to the track bed frame, and retractable wheels rotatably connected to the motor and to a portion of the frame adjacent the rear end of the treadmill. The retractable wheels are preferably attached to an incline bracket which is connected to the motor. The incline bracket is preferably rotatably attached to an extension tube which is attached to the motor. Control wiring, for controlling the electric motor, is preferably attached along an outer surface of the support to a console so that the wiring may be covered by a support cover which attaches to the support. A compression biased gas spring is preferably attached to the support and track bed frame for assisting in the lifting of the track bed. A latch preferably interfaces with a portion of the gas spring attached to the frame.

The invention further provides for methods of operating a foldable treadmill. A track bed, which is rotatably attached at one end to a support is lowered. This action, compresses a gas spring, which is attached at one end to the track bed and at its other end to a support. The track bed may, further be unlatched from the support, before the bed is lowered.

The track bed, which is rotatably attached at one end to a support, may also be raised. This action, decompresses a gas spring, which is attached at one end to the track bed and at its other end to a support. The track bed may then be raised to a level where it is latched to the support.

The invention also provides a method of operating a retractable incline system. An incline motor, attached to a middle portion of a frame may be activated to retract or extend a motor tube which is connected to an incline bracket. This action rotates the incline bracket which is also connected to a rear portion of the frame to lower or raise a set of wheels connected at ends of the incline bracket.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

BRIEF DESCRIPTION OF THE DRAWINGS

FIG. 3 is a side view of a preferred embodiment of the invention with the track bed also shown slightly raised in phantom.

FIG. 4 is a side view of a preferred embodiment of the invention in the up-right position with the track bed shown partially lowered in phantom.

FIG. 5 is an enlarged cut away perspective view of an embodiment of the latch in the locked position.

DETAILED DESCRIPTION OF THE PRESENTLY PREFERRED EMBODIMENTS

Figure 2:
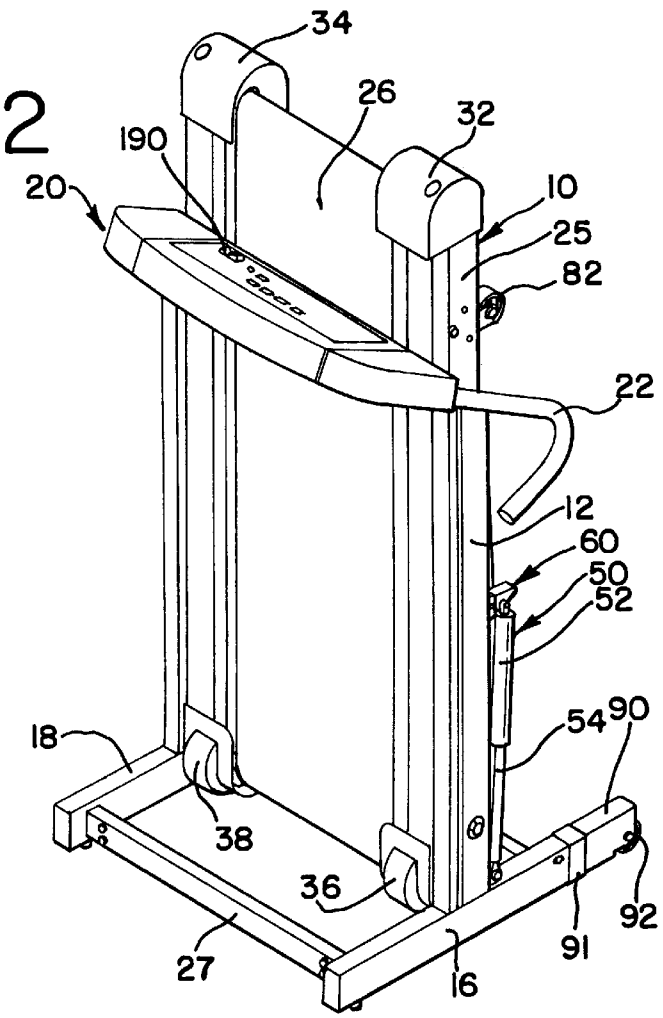
FIG. 2 is a perspective view of a preferred embodiment of the invention in the up-right position.
Figure 1:
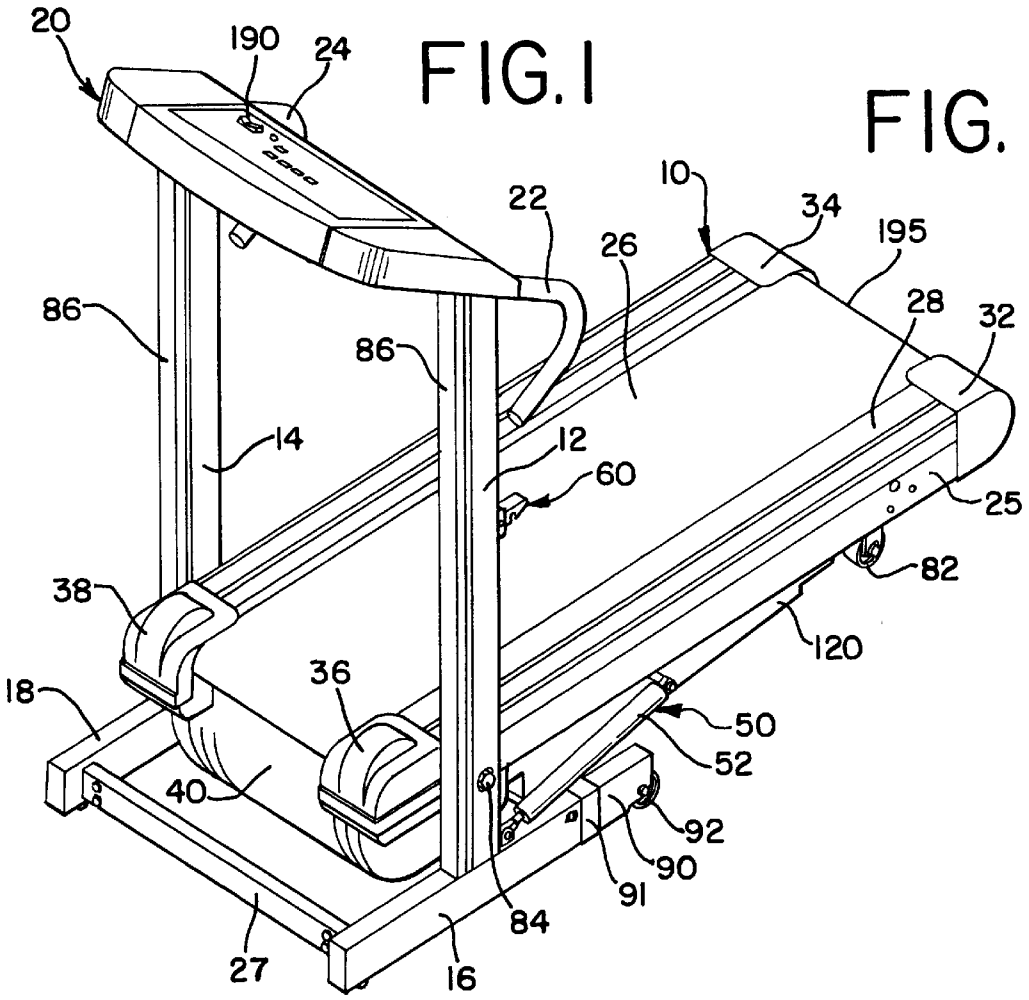
FIG. 1 is a perspective view of a preferred embodiment of the invention with the track bed in an operation or down position.

Referring to FIGS. 1–4, a preferred embodiment of the treadmill is shown having a track bed 10, up-right support legs 12, 14, base supports 16, 18 and console 20. Extending from an upper portion of the support legs 12, 14 are handrails 22, 24. Track bed 10 includes frame 25, tread belt 26, side rails 28, 30, rear end caps 32, 34 and front end caps 36, 38. A motor housing 40, and frame cover 120 are attached to the underside of the frame 25. The end caps 32, 34, 36, 38, motor housing 40, and frame cover 120 are preferable made of a rigid plastic. The frame 25 is preferably made of rectangular steel tubing.

Figure 8:
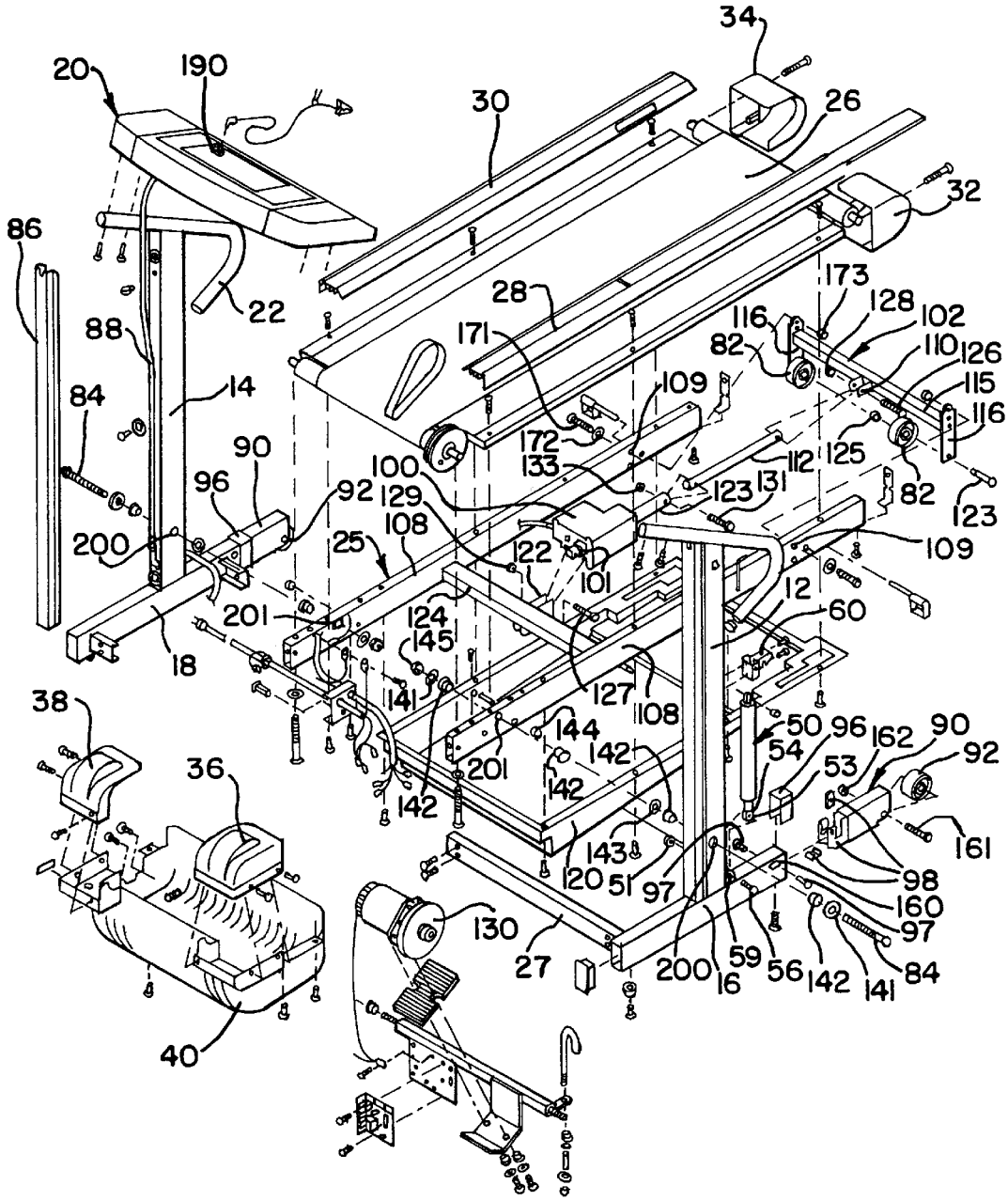
FIG. 8 is an exploded perspective view of an embodiment of the invention.

As shown in FIG. 8, the frame 25 preferably includes two frame tubes 108 oriented parallel to each other and separated by a frame cross tube 111, which is oriented perpendicular to frame tubes 108. In an embodiment, for example, frame tubes 108 may have a length of 56 inches, and frame cross tube 111 may have a length of 21 inches. Support bases 16, 18 and legs 12, 14 are also preferably formed of rectangular steel tubing, but any other rigid material may be alternatively used. Support bases 16, 18 are oriented parallel to each other and separated by cross support bases 27, 29, as shown in FIG. 2. In an embodiment, for example, support bases 16, 18 may have a length of 22 inches, and cross support bases 27, 29 may have a length of 24 inches.

A gas spring 50 has a gas, preferably nitrogen, filled cylinder 52, and a plunger 54, which is slidably attached to cylinder 52. The fully extended gas spring 50 is shown in FIG. 4. The retracted gas spring 50 is shown in FIG. 3. In an embodiment, for example, the spring may have a length of 14 inches retracted, and 24 inches fully extended. Plunger 54 is rotatably attached to, preferably, an upper surface portion of support base 16, adjacent support leg 12. Preferably, as shown in FIG. 8, the end of plunger 54 has opening 53 which aligns with openings in bracket 59 and is fastened with a bolt and locknut to allow rotation of the gas spring 50 as the track bed 10 is raised and lowered. Cylinder 52 is attached to a side portion of the side rail 28 with rod 58, which is preferably welded to a bottom portion of frame 25, as shown in FIGS. 5–7.

Referring to FIG. 5, an enlarged view of latch 60 is shown interfacing with rod 58. Latch 60 includes a latch head 62 which has a tapered underside 70 to allow the rod 58 to contact with its front end and rotate latch head 62 upward. A bracket 64 has openings which align with opening in a rear portion of the latch head 62. A bolt 66 passes through bracket 64 and latch head openings to allow latch head 62 to partially rotate. Preferably, a compression biased metal spring 68 is positioned within the bracket 64 to bias latch head 62 to a slightly declined position. Metal spring 68 is held in place with sleeve 67, shown in phantom. Alternatively, latch head 62 may preferably interface with gas spring 50 and rod 58, as shown in FIGS. 6–7.

Figure 6:
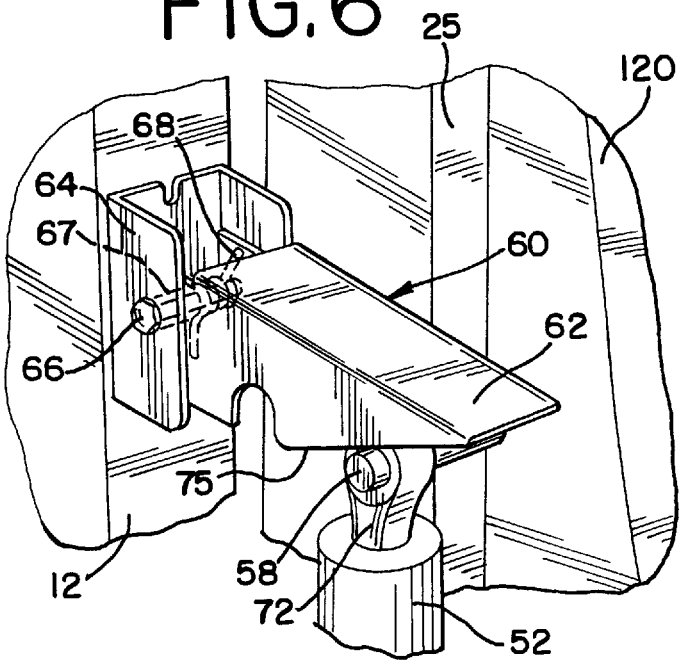
FIG. 6 is an enlarged cut away perspective view of an alternative embodiment of the latch interface with the gas spring and rod in an unlocked position.
Figure 7:
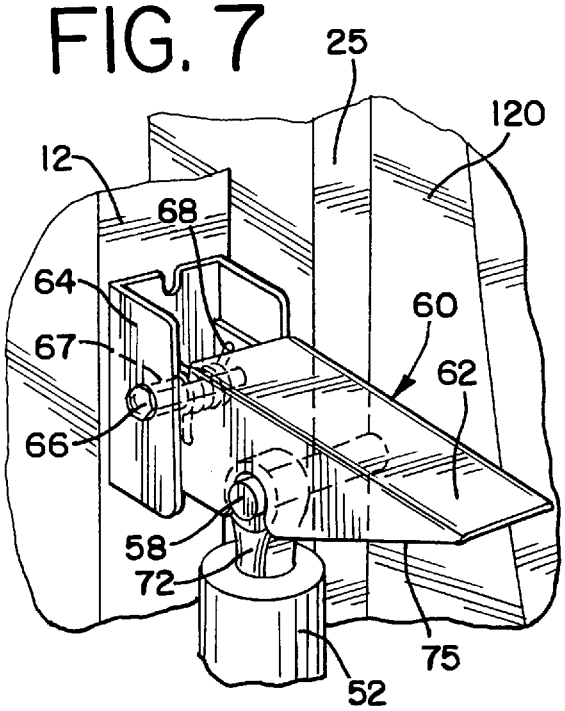
FIG. 7 is an enlarged perspective view of the latch of FIG. 6 in the locked position.

As shown in FIG. 6, as track bed 10 is folded upward, a point is reached, which may vary with the force rating of gas spring 50, where no human contact is necessary to continue the rotation of the track bed 10 to the locked or latched position, as shown in FIG. 7. The automatic latching continues, with rod 58 first contacting the bottom surface of the outermost tip of latch head 62. As track bed 10 continues its rotation to the locked position, rod 58 rides along the tapered bottom surface 75 of latch head 62. The declining angle of the tapered surface 75 forces latch head 62 to rotate upward, which, in turn, further compresses metal spring 68, which is in contact with an upper rear portion of latch head 62. As track bed 10 continues its rotation, rod 58 is received in a notch 74 formed in the sides of latch head 62. This allows spring 68 to force latch head 62 to rotate downward to the locked position.

Track bed 10 will remain securely fastened to support 12 until the user physically lifts up on the front end of latch head 62. Even in the unlatched position, track bed 10 will remain in the up-right position. The user must then pull track bed 10 forward against the force of gas spring 50 to lower track bed 10 to the down position. Depending on the force rating of gas spring 50, which for a preferred embodiment is 160 lbs., track bed 10 may be rotated to a position at least as far as the phantom track bed 80, as shown in FIG. 4, without falling.

Referring to FIGS. 3 and 4, the assist action of gas spring 50 is shown. In the operating or down position, track bed 10 is positioned, as shown in FIG. 3, with track bed 10 contacting the ground at the wheel set 82. To fold track bed 10, the user lifts up on the rear end 195 of track bed 10. The track bed 10 rotates about an axis which runs perpendicular to up-right support legs 12, 14, where a forward end of track bed 10 is rotatably connected to a lower portion of support legs 12, 14. Track bed 10 is rotatably attached to support legs 12, 14. In an embodiment, for example, track bed 10 may be attached to support legs 12, 14, at a point approximately 6 inches from the ground. As shown in FIG. 8, track bed 10 is preferably connected to legs 12, 14 with long hex head bolts 84, washers 141, 143, bushings 142, and locknuts 145 which are inserted through openings 200 in legs 12, 14, that are aligned with openings 201 in the frame 25.

As shown in FIG. 3, in the down position, plunger 54 is substantially enclosed within cylinder 52. This causes the gas, for example, nitrogen, within the cylinder 52 to be further compressed. The compressed cylinder 52 exerts a constant outward force in the direction in which the cylinder is oriented. Even at the down position, gas shock 50 is oriented at an incline to provide a vertical force vector component. As track bed 78 is raised, plunger 54 pushes outward from cylinder 52 until it reaches the up-right position as shown in FIG. 4.

Without gas spring 50, the user would experience a heavy load, for example, in the range of approximately 30 lbs. of lifting weight when lifting track bed 10 from the down position. For example, with the aid of gas spring 50 (e.g. with a 160 lb. rating), the user experiences a significantly reduced load, preferably in the range of only 15 lbs. of lifting weight when raising track bed 10. Alternative designs may include more than one gas spring of a reduced force rating, which equal the rating of gas spring 50. Each of these reduced force springs may be attached to support bases 16, 18, adjacent each of the support legs 12, 14 and to opposite sides of frame 25. Alternatively, longer or shorter gas springs may be used. If a longer gas spring is used, the latch 60 may preferably be positioned at a higher position on the leg 12. Alternatively, with a shorter gas spring, latch 60 could still receive rod 58 for convenient access. In an embodiment, for example, the rod may be positioned 26 inches from the ground.

The force rating of a gas spring should be chosen based on, and will vary with the specific configuration and weight of the treadmill. If a gas spring having a greater force rating than necessary is used, the track bed may bounce during use. An undersized gas spring may be insufficient to prevent the bed from falling rapidly once unlatched. In addition, an undersized spring would provide less assistance for the user when folding the track bed to the up-right folded position.

Referring to FIG. 7, an alternative preferred interface of latch 60 and gas spring 50 is shown in the locked position. In this embodiment, the extended portion 76 of cylinder 52 is positioned directly beneath latch head 62 and is enclosed between the sides of latch head 62. Notch 74 receives rod 58, which extends through an opening in extended portion 76.

Referring to FIG. 8, an exploded view of a preferred embodiment of the treadmill is shown. Support bases 16, 18 include wheel bracket extenders 90. Extenders 90 are made, preferably, of steel or some other rigid material. Extenders 90 are provided as a separate component that must be assembled by the end user by bolting them to the respective support bases 16, 18. Extenders 90 are provided as component parts to allow for a reduced shipping box size. This size reduction allows for many more treadmill boxes per pallet, which drastically reduces shipping costs. By extending the effective length of support bases 16, 18 extenders 90 counteract the force exerted by gas spring 50. In an embodiment, for example, support bases may have a length of 6 inches. Without extenders 90, for the embodiment shown, the entire treadmill would tip over when the user attempts to lower track bed 10. Alternatively, support bases 16, 18, which may have a length of approximately 22 inches, could be constructed having a longer length. At the end of extenders 90, wheels 92 are rotatably bolted. When positioning the treadmill, the user may grasp handles 22, 24, with the treadmill in the locked position, and tilt the treadmill so its weight is on wheels 92. From this position the treadmill may be pulled or pushed to a desired location or position.

Also shown in FIG. 8, is an exploded view of an electric incline motor 100, which is attached to frame 25, at bracket 122, which extends from cross tube 124. Movably attached to motor 100 is motor tube 123. An extension tube 112 is formed as a separate component for ease of assembly, but may alternatively be formed as a unitary member with motor tube 123. The tubes 123, 112 preferably are connected through aligned openings in each of the tubes with a bolt 131 and locknut 133. At its other end, extension tube 112 is attached to incline bracket 102. Incline bracket 102 includes, cross bar 115, wheel bracket members 116, and wheels 82. Cross bar 115 and wheel bracket members 116 are preferably made of steel, and the wheels 82 are preferably made of rubber or plastic. Preferably, the attachment of wheels 82 is made through openings in a bracket 110, extending from cross bar 115, and through openings in extension tube 112, with a bolt 126 and locknut 128. Wheel bracket members 116 have openings at both ends for rotatably attaching to frame 25 and to wheels 82. The rotatable attachment to frame 25 is preferably through openings 109 formed in frame tubes 108 and opening formed in wheel bracket members 116 with a bolt 171, washer 172 and locknut 173. Wheels 82 are rotatably attached through openings formed at the opposite end of wheel bracket members 116, with preferably a bolt 123 and capnut 125. When incline bracket 102 is in the fully extended position, wheel bracket members 116 are generally perpendicular to frame tubes 108, and wheels 82 are, in an embodiment, for example, approximately 4.5 inches from the bottom surface of frame 25. This provides the user, a near horizontal running surface, although preferably, track bed 10 remains at a slight incline even when wheels 82 are fully extended. When wheels 82 are fully retracted, they remain partially extended from frame cover 120 and are the only contact points with the ground, at the rear end of the track bed 10.

Incline motor 100 is activated at console 20 by depressing an incline switch 190, which is electrically connected to incline motor 100 with control wiring 88. For efficient manufacturing assembly, control wires 88 are run along a side of support leg 14, and a support cover 86 is snap-fitted onto the support leg to conceal the wiring 88.

When activated to extend wheels 82, incline motor 100 will retract the extension tube 112 in a direction toward the forward end of the treadmill. This causes incline bracket 102 to rotate about an axis which coincides with the rotatable connection points of wheel bracket members 116 and frame tubes 108. The motor will automatically deactivate when wheel bracket members 116 are approximately perpendicular to the frame 25. To provide a steeper incline, wheels 82 may be retracted. To retract wheels 82, incline motor 100 reverses the direction of motor tube 123, thus forcing the extension tube 112 toward the rear end 195 of the treadmill. This action, in turn, reverses the rotation of incline bracket 102, and rotates wheels 82 to a partially concealed position within frame cover 120.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. A foldable treadmill comprising:

a track bed including a forward end and a rear end, the track bed rotatably attached to a support adjacent the forward end of the track bed, a gas spring including a first end attached to the track bed and a second end attached to the support, the gas spring providing an upward force to assist a user in rotating the track bed between an operating position and a storage position where the rear end of the treadmill is positioned toward the support.

2. The foldable treadmill of claim 1 wherein the support includes an upright portion and a base portion.

3. The foldable treadmill of claim 2 wherein the second end of the gas spring is attached to the base portion of the support.

4. The foldable treadmill of claim 3 wherein the track bed includes a frame, the first end of the gas spring attached to the frame.

5. The foldable treadmill of claim 2 wherein the track bed includes an opening formed adjacent the forward end of the track bed, and an extended member fitting within the track bed opening and secured to the upright portion of the support.

6. The foldable treadmill of claim 2 wherein the upright portion of the support includes an opening formed therein, an extended member fitting within the support opening and secured to the track bed.

7. The foldable treadmill of claim 2 wherein the track bed includes a frame having two openings formed through side portions of the frame, the upright portion including two upright support legs, each of the upright support legs including an opening aligned with the frame openings, a fastener positioned within each of the frame openings and upright support leg openings to allow the track bed to rotate on the support.

8. The foldable treadmill of claim 2 further comprising an extender attached to each of the base supports.

9. The foldable treadmill of claim 1 further comprising a latch to lock the track bed to the support when the track bed is in the storage position.

10. The foldable treadmill of claim 9 wherein the latch is attached to the support and adapted to releasably connect to a locking member which is attached to the track bed.

11. The foldable treadmill of claim 10 wherein the latch attaches to a rod extending from the track bed and attached to the spring.

12. The foldable treadmill of claim 1 further comprising an electric motor attached to the track bed.

13. The foldable treadmill of claim 12 wherein the electric motor is positioned on an underside and forward end of the track bed.

14. The foldable treadmill of claim 13 further comprising a second electric motor attached to the underside of the track bed, the second motor in communication with an incline bracket positioned adjacent the rear of the track bed.

15. The foldable treadmill of claim 14 further comprising retractable wheels rotatably attached to the incline bracket.

16. The foldable treadmill of claim 1 wherein the gas spring comprises a plunger movably engaged with a gas filled cylinder.

17. The foldable treadmill of claim 16 wherein an outer end of the plunger is attached to the support and the cylinder is attached to the track bed.

18. A method of operating a foldable treadmill:

providing a track bed including a forward end and a rear end, the track bed rotatably attached to a support adjacent the forward end of the track bed, a gas spring including a first end attached to the track bed and a second end attached to the support, the gas spring providing an upward force;

rotating the track bed between an operating position and a storage position where the rear end of the track bed is positioned toward the support; and assisting the rotating of the track bed through use of the gas spring which prevents the track bed from falling rapidly from the upright storage position and reduces the effective weight of the track bed when rotating the track bed from the operating position to the storage position.

19. A method of operating a foldable treadmill comprising:

providing a track bed including a forward end rotatably attached to an upright portion of a support;

lowering a track bed from a storage position where a rear end of the track bed is positioned toward the support to an operating position;

compressing a gas spring which is attached at a first end to the track bed and at a second end to the support.

20. The method of claim 19 further comprising unlatching the track bed from the support while the track bed is in the upright storage position.

21. A method of operating a foldable treadmill comprising:

providing a track bed including a forward end rotatably attached to an upright portion of a support; and raising the track bed from an operating position to an upright storage position where a rear end of the track bed is positioned toward the support; and decompressing a gas spring which is attached at a first end to the track bed and at a second end to the support.

22. The method of claim 21 further comprising latching the track bed to the support in the upright storage position.

23. A treadmill comprising:

support structure including base means for positioning on a support surface to be free standing and including upright structure extending upwardly from said base means;

a track bed including a frame that includes a front, a rear, a left side, a right side and an endless belt positioned between said left side and said right side, the frame being connected to the support structure near the front to be movable between a first position in which said endless belt is positioned for operation by a user positioned thereon and a second position in which the rear of the frame is positioned toward the support structure; and gas spring assist means interconnected between the support structure and the track bed providing an upward force to assist in the movement of the track bed from the first position to the second position.

* * * * *